US005966876A

United States Patent [19]

Neathery et al.

[11] Patent Number: 5,966,876

[45] Date of Patent: Oct. 19, 1999

[54] MANHOLE INSERT AND TETHER APPARATUS AND METHOD

[75] Inventors: David L. Neathery, Shreveport, La.; Timothy B. Ely, Fairfield, Conn.; Michael D. Humke, Minden; Michael W. Humke, Haughton, both of La.

[73] Assignee: Southwestern Packing & Seals Inc., Shreveport, La.

[21] Appl. No.: 08/953,742

[22] Filed: Oct. 17, 1997

[51] Int. Cl.[6] ..... E02D 29/14

[52] U.S. Cl. ..... 52/20; 52/19; 70/164; 70/49; 292/237; 404/25; 404/26

[58] Field of Search ..... 52/19, 20, 21; 404/25, 26; 292/148, 264, 237; 70/164, 49

[56] References Cited

U.S. PATENT DOCUMENTS

| | | | |
|---|---|---|---|
| 374,458 | 12/1887 | Davis | 52/20 |
| 606,554 | 6/1898 | Jacobs | 404/25 |
| 1,384,712 | 7/1921 | Shanley | 52/20 |
| 1,959,171 | 5/1934 | Mayer | 94/35 |
| 2,576,353 | 11/1951 | Nelson | 182/31 |
| 3,046,853 | 7/1962 | Legendre | 94/34 |
| 3,490,177 | 1/1970 | Perrion | 52/19 |
| 3,712,009 | 1/1973 | Campagna | 52/20 |
| 3,920,347 | 11/1975 | Sauriol et al. | 404/25 |
| 4,067,659 | 1/1978 | Campagna, Jr. | 404/25 |
| 4,101,154 | 7/1978 | Kagstrom | 292/237 |
| 4,123,184 | 10/1978 | Whitlock | 404/25 |
| 4,171,851 | 10/1979 | Scruggs | 301/37 |
| 4,649,674 | 3/1987 | Gaul et al. | 52/20 |
| 4,650,365 | 3/1987 | Runnels | 404/25 |
| 4,915,336 | 4/1990 | Handy | 248/222.1 |
| 4,919,564 | 4/1990 | Neathery | 404/25 |
| 5,070,712 | 12/1991 | Fox | 70/49 |
| 5,197,307 | 3/1993 | Abbott, Jr. | 70/164 |
| 5,328,291 | 7/1994 | Wisniewski | 401/2 |

FOREIGN PATENT DOCUMENTS 41210 4/1908 Switzerland .

*Primary Examiner*—Carl D. Friedman
*Assistant Examiner*—Winnie S. Yip

[57] ABSTRACT

A watertight manhole insert and tether apparatus designed to prevent rainwater from entering sanitary sewer or other systems through a manhole closed by a manhole cover. The manhole insert is located beneath the manhole cover and is connected directly to the manhole by a tether apparatus mounted in the manhole, to plug the manhole, prevent theft of the manhole insert and deny access to the manhole. The manhole insert is characterized by a pan-shaped insert body having a curved, flat or ribbed insert bottom and one or more pressure-relief valves, one or more lift straps and an upward-standing, sloping or perpendicular side wall fitted with an outwardly-extending top rim for engaging a shoulder shaped in the manhole to support the manhole insert in the manhole. One end of a flexible stainless steel tether is connected to the manhole insert and the opposite end extends through a pair of tether mount loops fixed to the manhole wall and then through a grommet in the insert bottom and subsequently through a locking device. According to the method of this invention when the manhole insert is placed in the manhole, the tether is tightened in the tether mount loops as it is pulled upwardly through the grommet and the locking device is slipped along the tether above the grommet and locked at the insert body to seat the manhole insert on the manhole shoulder and prevent both theft of the manhole insert and access to the manhole.

28 Claims, 2 Drawing Sheets

MANHOLE INSERT AND TETHER APPARATUS AND METHOD

BACKGROUND OF THE INVENTION

1. Field of the Invention

This invention relates to manholes for sewer and other systems and more particularly, to a substantially watertight manhole insert and tether apparatus which is designed to seal the manhole immediately beneath a manhole cover and prevent flooding of the systems. In a preferred embodiment of the invention the manhole insert is characterized by a stainless steel, cylindrical, pan-shaped insert body having a rounded, ribbed or flat insert bottom provided with one or more pressure relief valves and connected to a tether system for securing the insert body in the manhole. The insert body has upward-standing, sloping or perpendicular sides extending from the insert bottom and terminated by an outwardly-projecting rim adapted for seating on a shoulder formed in the manhole beneath the manhole cover. The outwardly-extending rim may be seated directly on the manhole shoulder or on a seal to minimize the flow of water, sediment and contaminants from ground level around the manhole cover and through the manhole, into the sewer systems. The insert bottom receives one end of the tether through a rubber grommet extending through an opening in the insert bottom and the opposite end of the tether is extended through a pair of tether mount loops secured in the manhole wall beneath the manhole insert and terminates in fixed attachment to a keyhole clip bolted or otherwise secured to the insert bottom and spaced from the rubber grommet. Both ends of a lift strap or straps may be attached to the insert bottom opposite or adjacent to the tether, or both, typically by means of the keyhole clip mount bolt, to facilitate lifting and removing the manhole insert from a mounted position in the manhole, throughout the length of the tether. In a preferred embodiment of the invention the tether is secured in the manhole insert by a lever-type locking device as follows. The tether is threaded through a tether opening provided in one end of an elongated, U-shaped lever bar receptacle and through a registering, transversely-offset tether opening included in one end of a rectangular lever bar extending angularly or perpendicularly from the lever bar receptacle. The lever bar receptacle and lever bar together constitute a locking device for securing the manhole insert in the manhole, as described in my copending application Ser. No. 08/329,064, filed Oct. 20, 1994. After the manhole insert has been placed in the manhole, the tether is tightened through the spaced-apart tether mount loops and pulled upwardly through the rubber grommet provided in the insert bottom and the locking device is slipped along the tether to the grommet and subsequently locked onto the tether to securely seat the insert body of the manhole insert uniformly against the manhole shoulder. Locking of the locking device on the tether is accomplished as the lever bar is pivoted to lie entirely in the lever bar receptacle and the tether opening provided in the lever bar is shifted in a camming increment to misalign with the tether openings provided in the lever bar receptacle, thus crimping the tether and preventing the tether from slipping through the grommet. The hasp of a padlock is then extended through registering lock openings provided in the lever bar receptacle and lever bar and the padlock locked, to prevent reverse manipulation of the lever bar, access to the manhole and/or theft of the manhole insert. Since the tether is effectively then connected to the manhole insert at two spaced-apart points and the tether extends through the two, preferably diametrically-opposed, tether mount loops fixed in the manhole wall, the manhole insert cannot be tipped or removed from the manhole shoulder. The pressure relief valve installed in the insert bottom is designed to relieve pressure which may be generated in the sewerage system served by the manhole and also operates to relieve any vacuum which may develop in the sewer system.

One of the problems which is associated with sewer systems is that of flooding during periods of high water due to prolonged or heavy rainfall. This problem is intensified in both urban and surburban areas where increased construction activity has resulted in large quantities of concrete being poured to construct parking lots, as well as foundations and other structures. This proliferation of non-permeable construction material reduces the amount of surface area which is available to absorb rainfall and increases the flow of water in storm drains and sewer systems, as well as diversion canals, natural streams and other channels which must accept and dispose of the increased flow of water. These conditions of urban and suburban development result in flooding under circumstances where the water run-off exceeds the capacity of the storm drain and sewer systems, which are sized to receive a specified average flow of water. Moreover, although it is customary to provide separate drainage systems for rainwater and sewage, flooding of the sewerage systems by rainwater runoff sometimes creates a contamination problem.

Another problem relating to sewer and other systems is the unauthorized entry of these subterranean tunnels by children and adults for various purposes. Sewer lines and tunnels may contain toxic and/or flammable gases, low oxygen, liquid contaminants and like hazards. Furthermore, sudden rainstorms can quickly flood sewerage systems and due to the extensive network of pipes, channels and tunnels in such a system, people can easily become lost in the underground labyrinth.

2. Description of the Prior Art

Various types of closures and covers, many of which are fitted with ventilating means, have been long known in the art. An early German Patent No. 41,210 details a manhole having a removable cover connected to the manhole by a chain. Another early patent which details such a closure is the "Ventilating Vault Cover", detailed in U.S. Pat. No. 606,554, dated Jun. 28, 1898, to J. Jacobs. The ventilating vault cover is designed to close a vault opening in a watertight manner when in a closed position and vent the vault when in open configuration. U.S. Pat. No. 1,959,171, dated May 15, 1934, to N. C. Mayer shows a manhole construction which includes an adapter for raising a manhole cover after road construction. U.S. Pat. No. 3,046,853, dated Jul. 31, 1962, to C. Legendre, discloses a "Manhole Closure". The manhole closure includes a lid of one-piece construction which cooperates with a seat or manhole frame, also of one-piece construction, such that the two parts can be easily assembled for mounting in a manhole. A "Safety Replacement Cover for Catch Basins" is detailed in U.S. Pat. No. 2,576,353, dated Nov. 27, 1951, to O. W. Nelson. The cover detailed in this patent includes a dish-like, reticulate tray which is designed to provide adequate drainage into a catch basin and facilitates safety to prevent injury from stepping into the catch basin. A "Manhole Cover" is covered in U.S. Pat. No. 3,920,347, dated Nov. 18, 1975, to John T. Sauriol, et al. The manhole cover is constructed of a molded synthetic polymeric material and has a transversely intersecting structural rib network which is integrally joined with a top surface portion and encloses annular peripheral portions of the cover. The structural rib network is preferably dome-shaped, with the principal structural support disposed centrally of the cover at the apex of the dome. A "Drain Hole Seal With Bottom Bleeder" is detailed in U.S. Pat. No. 4,649,674, dated Mar. 17, 1987, to Craig S. Gaul, et al. The patent details a seal structure having a bottom bleeding feature such as a bottom bore and fitted with a flange to facilitate sealing engagement between a cover and a frame located around an access opening of the manhole. The structure includes a central portion which is downwardly depressed to avoid a path of spin of the cover. A "Watertight Manhole Insert" is set forth in U.S. Pat. No. 4,650,365, dated Mar. 17, 1987, to Franklin D. Runnels. The manhole insert is designed to prevent rainwater from entering a sanitary sewer system through manholes which are closed by manhole covers. The insert includes a shallow, dish-shaped body portion and a mounting flange designed to rest upon the supporting flange of a manhole frame. A recess is formed in the bottom of the body portion and includes a valve for releasing any pressure which may accumulate in the manhole beneath the insert. The valve is shielded to prevent damage by a manhole cover sliding across the insert. Additionally, the valve can be used as a handle to remove the insert from the manhole. The Runnels insert has also been modified in application to include a circumferential rib near the rim for stiffening purposes. A "Manhole Closure Assembly", detailed in U.S. Pat. No. 4,067,659, dated Jan. 10, 1978, and a "Manhole Closure Assembly with Valve Relief Means" covered by U.S. Pat. No. 3,712,089, dated Jan. 23, 1973, are both issued to Samuel A. Campagna, Jr., et al. Both assemblies are designed to prevent accumulated storm water from entering a manhole opening and includes a cover section having a downwardly-depressed central portion. A circular mounting flange extends outwardly from the depressed central portion and the flange is adapted to rest upon inwardly-directed manhole cover supporting flanges of the annular manhole frame. The cover section is depressed, such that the cover exceeds the path of spin when resting upon the supporting flange of the manhole frame. A valve is secured to the cover section for the purpose of relieving pressure inside the manhole when the sewer pressure exceeds a predetermined level. My U.S. Pat. No. 4,919,564, issued Apr. 24, 1990, details a "Manhole Insert" characterized by a dish-shaped seal or stopper positioned below a manhole cover to plug the manhole and prevent flooding of the underlying sewer system. My U.S. Pat. No. 4,957,389, issued Sep. 18, 1990, covers a "Method And Apparatus for Sealing Manholes", using a donut-shaped seal structure in the chimney. Other patents which detail locking devices and restraints for securing lids and cables, include the following: U.S. Pat. No. 374,458, to J. P. Davis; U.S. Pat. No. 1,384,712, to F. Shanley; U.S. Pat. No. 5,070,712, to D. Fox; U.S. Pat. No. 3,490,177, to D. C. Perrion; U.S. Pat. No. 4,101,154 to Kagstrom; U.S. Pat. No. 4,171,851, to C. Scruggs; U.S. Pat. No. 5,328,291 to R. S. Wisniewski; and U.S. Pat. No. 5,197,307 to M. L. Abbott.

It is an object of this invention to provide a new and improved manhole insert and restraint or tether which is designed to close and substantially seal a manhole and prevent rainwater from flooding a sewer or other system communicating with the manhole, as well as secure the manhole insert in the manhole or within the length of the tether, to prevent unauthorized entry into the manhole and/or theft of the manhole insert.

Another object of the invention is to provide a manhole insert and tether apparatus, which manhole insert is molded, stamped or otherwise shaped from a selected metal or synthetic polymeric material into a pan-shaped, rounded, ribbed or flat-bottomed, flanged insert body for removable installation on a shoulder provided in a manhole beneath the manhole cover in order to prevent, or at least reduce, the flow of rainwater into the manhole and the underlying disposal system and prevent, or at least minimize, theft of the manhole insert and/or unauthorized entry of the manhole, by operation of the tether.

A still further object of this invention is to provide a stainless steel manhole insert characterized by a pan-shaped insert body having a rounded, ribbed or flat insert bottom and a bottom opening which slidably receives one end of a flexible, braided or stranded stainless steel tether, the opposite end of which tether is threaded through at least two tether mount loops fixedly spaced-apart in the manhole and is then bolted or otherwise fixed to the insert bottom at a point spaced from the bottom opening. A continuous side wall extends from the manhole insert bottom, with a flange or rim outwardly-extending from the side wall, which rim engages the shoulder of the manhole located beneath the manhole cover to retard water from flowing into the manhole and the underlying sewer or drainage system, while the tether drastically reduces the incidence of theft of the manhole insert and unauthorized tipping and entry into the manhole.

Yet another object of the invention is to provide a manhole insert and slidably connecting restraint or tether apparatus and a crimp or cam lock for retarding the flow of water into a sewer or other system through a manhole and substantially preventing access into the manhole and theft of the manhole insert. The manhole insert is characterized by a rounded, ribbed or flat-bottomed closure or insert body having an outwardly-projecting flange or rim optionally fitted with a rubber seal and further including one or more lift straps or handles attached to the dish-shaped closure or insert body, which manhole insert is located in the manhole beneath the manhole cover. The tether apparatus is bolted or otherwise fixed to a first selected point on the manhole insert, extends through spaced tether mount loops, preferably spaced across the diameter of the manhole and fixed to the manhole wall beneath the manhole insert and then through an opening in the manhole insert, where it can be locked to stabilize and secure the manhole insert in the manhole.

Still another object of this invention is to provide a new and improved manhole insert which includes a pan-shaped, rounded, ribbed or flat-bottomed stainless steel stopper, plug or insert body having one or more pressure relief valves mounted therein and further including an outwardly-extending rim fitted with a rubber seal and a flexible, braided or stranded stainless steel wire tether having one end extending through a grommet in the flat insert bottom of the insert body and fitted with a lever-operated, cam-type locking device, with the opposite end of the tether extending through a pair of tether mount loops attached to diametrically opposite points in the cylindrical manhole beneath the manhole insert and fixed to a point on the manhole insert which is spaced from the grommet. One or two lift straps are mounted on the manhole insert for removing the insert body from a manhole located beneath the manhole cover and a warning tag may be attached to at least one of the lift straps, as deemed necessary.

Another object of the invention is to provide a new and improved manhole insert characterized by a stainless steel, rounded, ribbed or flat-bottomed insert body which is fitted with a flared or perpendicular side and a flange or rim for mounting in the upper portion of a manhole beneath the manhole cover. Further included is a flexible stainless steel tether having one end attached to a keyhole clip bolted or otherwise fixed to the insert body and the opposite end extending through a pair of flexible tether mount loops mounted in the manhole wall across the diameter of the manhole, and further projecting through a grommet mounted in the insert bottom element of the insert body, which grommet is spaced from the keyhole clip. The opposite end of the tether then projects through a tether opening provided in one end of an elongated, U-shaped lever bar receptacle and through a registering, transversely-offset opening included in a rectangular lever bar accommodated in and extending angularly or perpendicularly from the lever bar receptacle, which lever bar is pivoted in a camming action to rest entirely in the lever bar receptacle, crimp the tether and thus prevent the tether from slipping through the grommet. A padlock may then be secured to the lever bar and lever bar receptacle to secure the manhole insert in the manhole, in order to reduce or prevent the flow of water into an underlying sewer system, control manhole odor, prevent the accumulation of dirt and trash in the manhole and the underlying sewer and substantially prevent theft of the manhole insert and unauthorized tipping of the manhole insert to gain access to the manhole.

A still further object of this invention is to provide a method of locking a manhole insert in a manhole beneath a manhole cover, which method includes the steps of seating a manhole insert in the manhole; providing an opening in the manhole insert body; extending a flexible tether through the opening and through a pair of tether mount loops fixed to the manhole wall and securing one end of the flexible tether to the manhole insert; and sliding a tether lock on the opposite end of the flexible tether in the manhole insert, such that the manhole insert is secured in the manhole opening responsive to tightening the flexible tether through the mount loops, pulling the flexible tether through the opening to tighten the flexible tether at two points between the insert body and the manhole, sliding the tether lock on the flexible tether to the insert body and locking the tether lock on the flexible tether. The tether lock may be further secured in place by a lock such as a padlock.

SUMMARY OF THE INVENTION

These and other objects of the invention are provided in a manhole insert and tether apparatus and a method for sealing and preventing unauthorized access into sewerage systems, which manhole insert is characterized in a preferred embodiment by a molded, stamped, pressed or otherwise formed, rounded, ribbed or flat-bottomed stainless steel insert body provided with one or more pressure and/or vacuum relief valves and an upward-standing, sloping or perpendicular side wall, terminated by an outwardly-projecting rim for seating on a ledge provided in a manhole beneath the manhole cover, in order to prevent rainwater from flowing around the edge of the manhole cover into the manhole and through the underlying sewer system. A flexible, stranded, stainless steel rope tether has one end connected by means of a cable clamp or stay to a keyhole clip bolted or otherwise mounted on the insert body and the opposite end of the tether extends through a pair of diametrically oppositely-disposed, flexible tether mount loops fixed in the manhole wall beneath the manhole insert and then through a rubber grommet mounted in the insert bottom in spaced relationship with respect to the keyhole clip. The opposite end of the tether subsequently projects through a locking device preferably characterized by a U-shaped lever bar receptacle and a lever bar extending from the lever bar receptacle and slidably mounted along with the lever bar on the tether, which lever bar is pivoted to rest entirely in the lever bar receptacle to crimp the tether by cam action and may be locked with a padlock to prevent the tether from slipping through the locking device and thus securely seat the lever bar receptacle against the insert body and the manhole insert in the manhole.

BRIEF DESCRIPTION OF THE DRAWING

The invention will be better understood by reference to the accompanying drawings, wherein.

DESCRIPTION OF THE PREFERRED EMBODIMENTS

Figure 1:
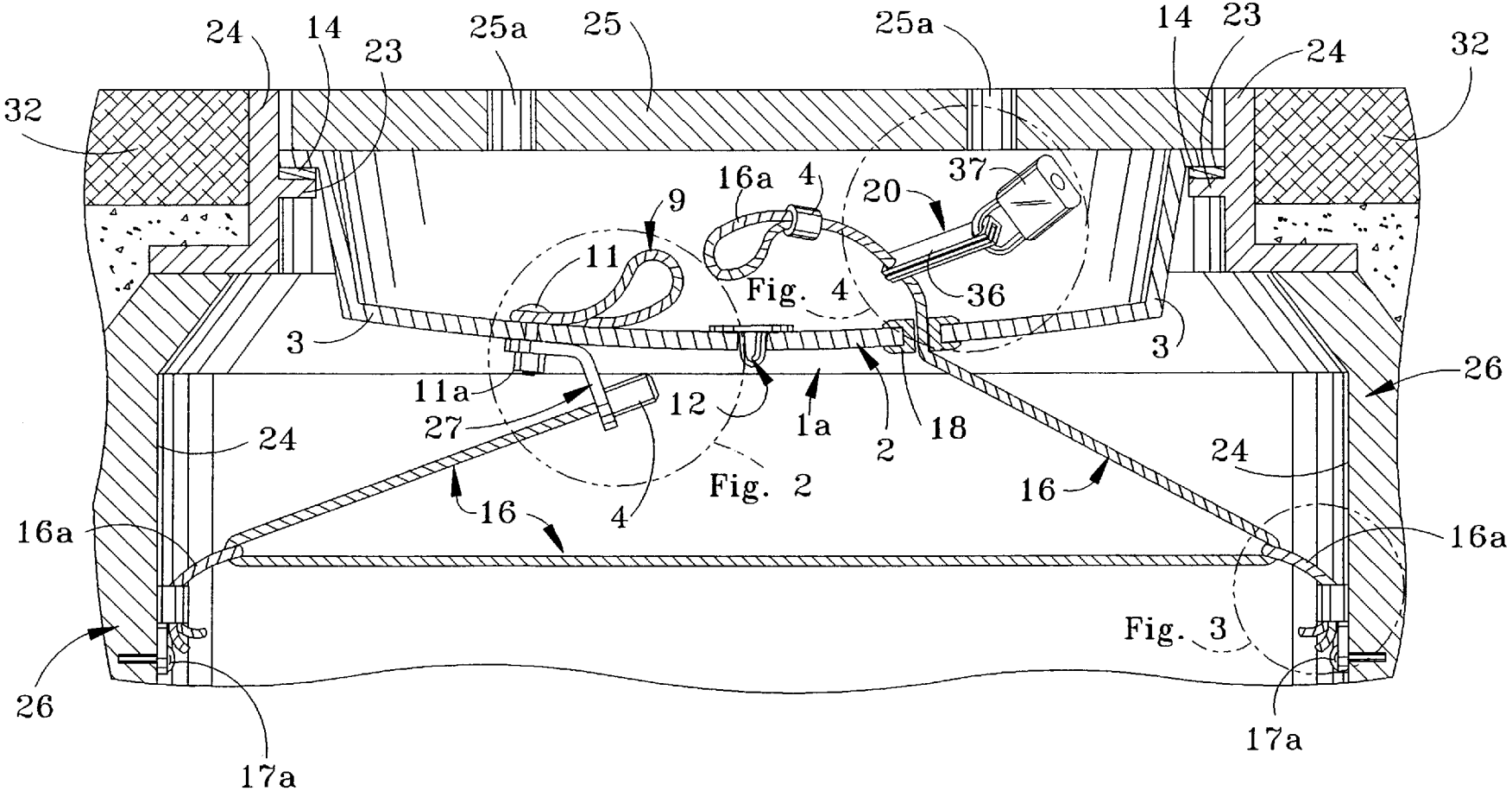
FIG. 1 is a sectional view of the manhole insert and tether apparatus of this invention, with the manhole insert illustrated in functional position in a manhole beneath a manhole cover and secured in the manhole by the tether apparatus.
Figure 2:
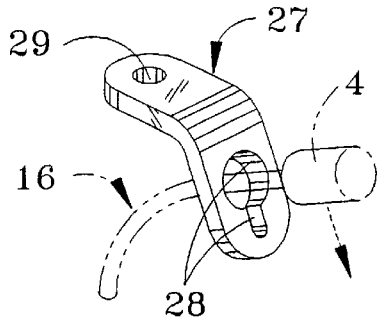
FIG. 2 is a perspective view of a keyhole clip for mounting on the manhole insert and removably receiving one end of the tether cable element of the tether apparatus illustrated in FIG. 1.
Figure 3:
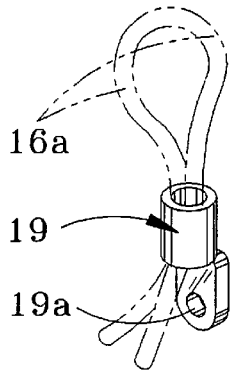
FIG. 3 is a perspective view of a typical loop mount for mounting a tether mount loop in the manhole.

Referring initially to FIGS. 1–3 of the drawing, the manhole insert and tether apparatus of this invention is generally illustrated by reference numeral 1. The manhole insert element is characterized by a dish or pan-shaped insert body 1*a*, including a substantially flat or slightly rounded insert bottom 2, having a smooth bottom surface 6, which terminates in a circular, upward-standing side wall 3. The side wall 3 may be substantially perpendicular with respect to the insert bottom 2, or disposed at an obtuse angle and sloped with respect to the insert bottom 2, as desired. A rim 5 projects substantially horizontally outwardly from the top edge of the side wall 3 and seats on a manhole shoulder 23, provided in the manhole structure 26 beneath the street level 32, as illustrated in FIG. 1 and hereinafter described. In a most preferred embodiment the manhole insert 1*a* is shaped from stainless steel or molded from a suitable moldable plastic material, as further hereinafter described. Alternatively, the manhole insert 1*a* can be stamped, pressed, cast or otherwise formed from other suitable metals such as aluminum, in non-exclusive particular. As further illustrated in FIG. 1, a pressure relief valve 12 includes a valve seat 13, mounted in a valve body 13*a* extending through the insert bottom 2. The valve seat 13 is lifted from the valve body 13*a* to release pressure which may build up in the manhole 22.

In a preferred embodiment of the invention the manhole insert 1 is mounted in the manhole 22 with the rim 5 of the manhole insert 1*a* engaging the manhole shoulder 23 located in the manhole structure 26, as illustrated in FIG. 1. In a most preferred embodiment of the invention a nitrile, neoprene or alternative gasket or seal 14 is fitted under the rim 5, lying adjacent to and resting on the manhole shoulder 23 of the manhole structure 26, as further illustrated in FIG. 1. As further illustrated in FIG. 1, the ends of a strap cable 10 of a lift strap 9 are fitted with a cable stay 4 and pressed on companion lift strap mount washer 7, secured to the insert bottom 2 by means of a clip mount bolt 11 and a companion nut 11*a*. One end of a length of flexible stainless steel tether 16 is shaped to define a tether loop 16*a* by means of a stainless steel cable stay 4, after looping through a grommet 18, seated in a bottom opening 8 provided in the insert bottom 2 of the manhole insert 1*a*. The opposite end of the tether 16 is threaded through a pair of flexible tether mount loops 16*a*, mounted in the manhole wall 24, preferably at diametrically opposite points, by means of bolt anchors 17*a* extending through the mount eyes 19*a* of the respective loop mounts 19, to define the tether apparatus 21. The bolt anchors 17*a* are typically mounted in holes drilled across the diameter (diametrically) in the manhole wall 24 of the manhole structure 26, as detailed in FIG. 1. Alternatively, the tether mount loops 16*a* may be secured to any desired chemical-resistant mounting anchor such as eye bolts and the like, which can be anchored to the manhole wall 24, according to the knowledge of those skilled in the art. Further in the alternative, the tether 16 can be looped through eyes provided in the bolt anchors 17*a*, as desired. The opposite end of the tether 16 is fitted with a cable stay 4 that removably locks into the keyhole 28 of a keyhole clip 27, illustrated in FIG. 2, bolted to the bottom surface 6 of the insert bottom 2 by means of the clip mount bolt 11 and nut 11*a*.

Figure 4:
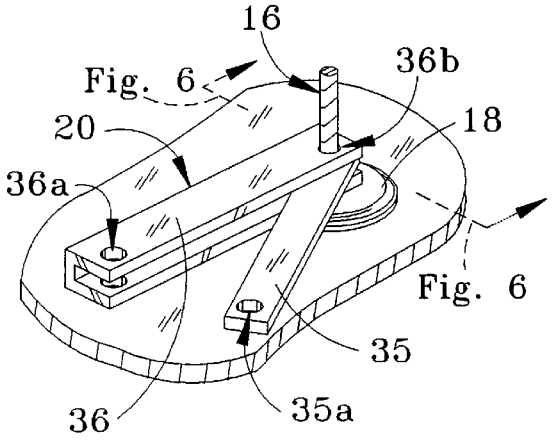
FIG. 4 is a perspective view of a lever-locking device in unlocked, non-cable crimping configuration.
Figure 5:
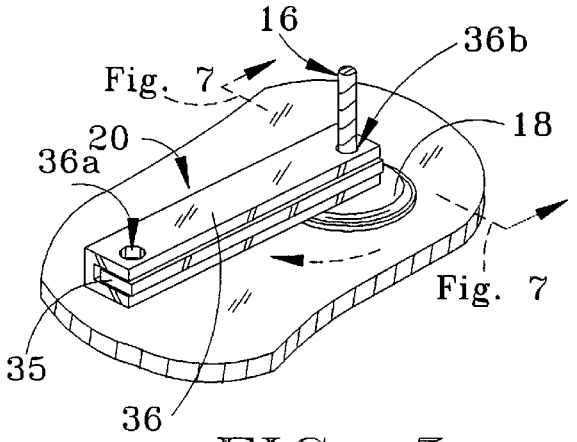
FIG. 5 is a perspective view of the locking device illustrated in FIG. 4, in locked, cable-crimping configuration and secured by a padlock.
Figure 6:
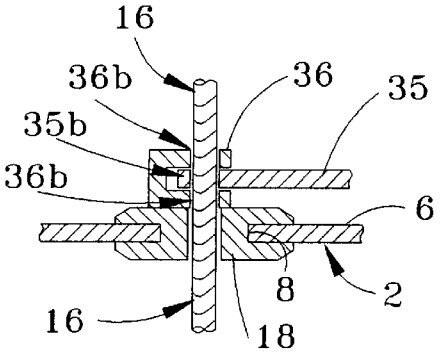
FIG. 6 is a sectional view taken along line 6—6 of the lever locking device illustrated in FIG. 4.
Figure 7:
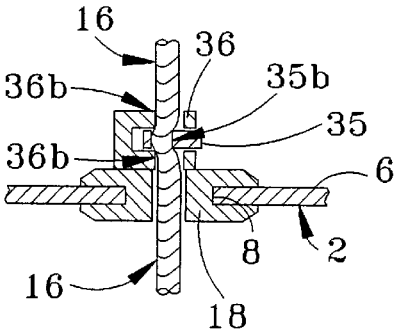
FIG. 7 is a sectional view taken along line 7—7 of the lever locking device illustrated in FIG. 5.

Referring now to FIGS. 1, and 4–7 of the drawing, a locking device 20 slidably engages that portion of the tether 16 extending above the bottom surface 6 of the insert bottom 2 for securely seating and locking the manhole insert 1 in the manhole 22, as hereinafter described. As illustrated in FIGS. 4 and 7, the locking device 20 includes an elongated lever bar receptacle 36 having a generally U-shaped cross-sectional configuration. A pair of aligned receptacle lock openings 36*a* are provided in opposite sides of the lever bar receptacle 36, adjacent to one end thereof, as illustrated in FIG. 4 and a pair of aligned receptacle tether openings 36*b* are also provided in opposite sides of the lever bar receptacle 36, adjacent to the other end thereof, as further illustrated in FIG. 4. A generally rectangular lever bar 35, having a transversely offset lever bar tether opening 35*b* adjacent to one end thereof and a lever bar lock opening 35*a*, adjacent to the other end thereof, is accommodated in the lever bar receptacle 36, with the lever bar tether opening 35*b* positioned substantially in registry with the receptacle tether openings 36*b* when the lever bar 35 is extending from the lever bar receptacle 36, as illustrated in FIG. 4. As illustrated in FIGS. 1 and 4, after extending through the grommet 18, the tether 16 first extends through one of the receptacle tether openings 36*b*, then through the lever bar tether opening 35*b* and finally through the other receptacle tether opening 36*b* and typically terminates in a tether loop 16*a*, fitted by a cable stay 4. FIGS. 5 and 7 illustrate the locking function of the locking device 20, as hereinafter described.

In operation, the manhole insert 1 is mounted in functional position in the manhole structure 26 by seating the rim 5 of the insert body 1*a* on the manhole shoulder 23, located in the manhole 22 below the street level 32, or on the seal 14, as illustrated in FIG. 1. The tether 16 of the tether apparatus 21 is tightened in the respective tether mount loops 16*a* and pulled upwardly through the grommet 18 and the locking device 20 is slipped downwardly on the tether 16 to engage that portion of the grommet 18 located on the bottom surface 6 of the manhole insert 1*a*, as illustrated in FIG. 1. The free length of tether 16 above the locking device 20 is coiled in the insert body 1*a*. The hasp 37*a* of a padlock 37 is then extended through one of the receptacle lock openings 36*a* (provided in one side of the lever bar receptacle 36), through the now registering lever bar lock opening 35*a* and finally, through the receptacle lock opening 36*a* provided in the other side of the lever bar receptacle 36 and locked, to secure the lever bar 35 and lever bar receptacle 36 in tether-crimping configuration and prevent the tether 16 from slipping through the grommet 18. It will be appreciated that the locking device 20 can be unlocked and the manhole insert 1 lifted from the functional position in the manhole 22 to the full length of the tether 16, as illustrated in FIG. 1, when the conventional manhole cover 25 is moved from the manhole 22. This tether lock and release expedient prevents theft of the manhole insert 1 and unauthorized entry into the manhole 22 yet allows removal of the manhole insert 1 from the manhole 22 for repair work in the manhole 22.

It will be further appreciated that while the manhole insert 1*a* can be configured from molded synthetic polymeric materials such as polyethylene, polypropylene and acrylonitrile-butadiene-styrene (commonly called ABS) as well as metals such as aluminum and steel, in non-exclusive particular, stainless steel is a preferred material of construction. Furthermore, the insert bottom 2 can be flat or rounded as illustrated in FIG. 1 ot it can be ribbed, as detailed in my U.S. Pat. No. 4,919,564. Moreover, in a most preferred embodiment of the invention, the pressure relief valve 12, mounted in the insert bottom 2, is designed to relieve manhole pressure in a pressure range of from about 0.5 psi to about 1.6 psi.

It will also be appreciated by those skilled in the art that the manhole insert and tether of this invention is characterized by convenience and flexibility and operates to stop the flow of water, sediment and contaminants into sewer systems, control manhole odors, prevent dirt and trash from accumulating in the manhole and the sewer system and helps to prevent manhole rattling and "flipping" due to street traffic. The tether 16 allows removal of the manhole insert 1 from the manhole 22 to provide access to the manhole 22, while preventing theft or other removal of the manhole insert 1 from the area of the manhole 22, as illustrated in FIG. 1. The tether 16 element of the tether apparatus 21 also serves to secure the manhole insert 1 in functional position in the manhole 22, as illustrated in FIG. 1 by initially unlocking the padlock 37 (or alternative locking device), pivoting the lever bar 35 from the lever bar receptacle 36 and allowing the tether 16 to slide inside the receptacle tether openings 36*b* and lever bar tether opening 35*b*. This facilitates sliding the tether 16 through the locking device 20 to tighten that segment of the tether 16 extending through the tether mount loops 16*a*. The lever bar 35 is then pivoted into the lever bar receptacle 36 to again crimp the tether 16 and secure the locking device 20 on the tether 16. The manhole insert 1 is thusly secured in the manhole 22, as heretofore described. The manhole insert 1 is then configured to be maintained in position on the manhole shoulder 23 in a manhole 22, with or without the seal 14, without dropping from that position into the manhole 22 or sewer underlying the manhole 22 and without the hazard of theft, tipping of the manhole insert 1 and unauthorized entry into the manhole 22, due to application of the tether 16. The rubber grommet 18 allows slippage of the tether 16 when the locking device 20 is in the unlocked, uncrimping configuration, but also facilitates seating of the tether 16—grommet 18 interface to prevent leakage of water from the manhole insert 1 into the manhole 22 and tipping of the manhole insert 1 from the manhole shoulder 23, since the tether apparatus 21 secures the manhole insert 1 on the manhole shoulder 23 at two points spaced from each other, on the manhole insert 1 and the manhole wall 24, respectively.

While the preferred embodiments of the invention have been described above, it will be recognized and understood that various modifications may be made therein and the appended claims are intended to cover all such modifications which may fall within the spirit and scope of the invention.

Having described my invention with the particularity set forth above,

What is claimed is:

1. A manhole insert and tether apparatus comprising an insert body for seating in the wall of a manhole and having a tether opening; a pair of loops adapted to be fixedly provided in the manhole wall in spaced relationship with respect to each other; a tether having one end slidably extending through said tether opening and said loops and the opposite end of said tether attached to said insert body in spaced relationship with respect to said tether opening; and a tether lock slidably carried by said one end of said tether for selectively tightly engaging said tether at said insert body and locking said insert body in the manhole.

2. The manhole insert and tether apparatus of claim 1 comprising at least one pressure relief means provided in said insert body for relieving pressure in the manhole.

3. The manhole insert and tether apparatus of claim 1 wherein said insert body comprises an insert bottom, a continuous side wall upward-standing from said insert bottom and a rim shaped in said side wall for supporting said insert body in the wall of the manhole.

4. The manhole insert and tether apparatus of claim 1 comprising at least one lift strap attached to said insert body for lifting said insert body from the manhole when said tether lock means is unlocked and slidably displaced on said tether.

5. The manhole insert and tether apparatus of claim 4 wherein said insert body comprises a bottom, a continuous side wall upward-standing from said insert bottom and a rim shaped in said side wall for supporting said insert body in the manhole and both ends of said lift strap are attached to said insert bottom.

6. The manhole insert and tether apparatus of claim 5 comprising a pressure relief valve provided in said insert bottom for relieving pressure in the manhole.

7. The manhole insert and tether apparatus of claim 6 comprising a padlock releasably engaging said tether lock for selectively locking said tether lock means on said tether.

8. The manhole insert and tether apparatus of claim 1 comprising a bracket mounted on said insert bottom and wherein said opposite end of said tether is connected to said bracket means.

9. The manhole insert and tether apparatus of claim 1 comprising a gasket for engaging the manhole wall and said rim for sealing said insert body in the manhole.

10. The manhole insert and tether apparatus of claim 1 wherein said tether lock comprises a locking device slidably engaging said tether and selectively crimping said tether for selectively locking said tether in said locking device.

11. The manhole insert and tether apparatus of claim 1 wherein said insert body comprises an insert bottom, a continuous side wall upward-standing from said insert bottom and a rim shaped in said side wall for supporting said insert body in the manhole and comprising at least one braided cable lift strap attached to said insert bottom for lifting said insert body from the manhole when the manhole cover is removed, and wherein said tether lock comprises a locking device slidably engaging said tether and selectively crimping said tether for selectively locking said tether in said locking device.

12. The manhole insert and tether apparatus of claim 11 comprising a pressure relief valve provided in said insert bottom for relieving pressure in the manhole.

13. The manhole insert and tether apparatus of claim 11 wherein said at least one braided cable lift strap comprises a pair of braided stainless steel lift straps.

14. The manhole insert and tether apparatus of claim 11 comprising a gasket for engaging the manhole wall and said rim and sealing said insert body in the manhole.

15. The manhole insert and tether apparatus of claim 11 comprising a keyhole clip mounted on said insert bottom and wherein said opposite end of said tether is connected to said keyhole clip.

16. The manhole insert and tether apparatus of claim 15 comprising a pressure relief valve provided in said insert bottom for relieving pressure in the manhole.

17. The manhole insert and tether apparatus of claim 11 comprising a keyhole clip positioned adjacent to said insert bottom and wherein said opposite end of said tether is connected to said keyhole clip and comprising a bolt connecting said keyhole clip and both ends of said braided cable lift strap to said insert bottom.

18. The manhole insert and tether apparatus of claim 17 comprising a gasket for engaging the manhole wall and said rim and sealing said insert body in the manhole, a pressure relief valve provided in said insert bottom for relieving pressure in the manhole and a padlock releasably engaging said tether lock for selectively locking said tether lock on said tether.

19. A manhole insert and tether apparatus comprising a generally pan-shaped insert body including an insert bottom having a tether opening and terminated by an upward-standing, continuous side wall having a top edge, for seating in a manhole having a manhole wall and a manhole shoulder; at least one pressure relief valve extending through said insert bottom for releasing pressure in the manhole; a rim shaped in said top edge of said side wall for engaging the shoulder of the manhole and supporting said insert body on the shoulder; a pair of loops adapted to be fixedly attached to the manhole wall in substantially diametric opposition with respect to each other; a flexible tether of selected length having one end extending through said tether opening in said insert bottom and the opposite end of said tether extending through said loops and attached to said insert bottom in spaced relationship with respect to said tether opening; and a tether lock slidably engaging said one end of said tether for selectively locking on said tether and securing said insert body in the manhole.

20. The manhole insert and tether apparatus of claim 19 comprising a gasket for engaging the manhole wall and said rim and sealing said insert body in the manhole and a padlock releasably engaging said tether lock for selectively locking said tether lock on said tether.

21. The manhole insert and tether apparatus of claim 19 comprising a bracket mounted on said insert bottom and wherein said opposite end of said tether is connected to said bracket.

22. The manhole insert and tether apparatus of claim 19 comprising at least one lift strap attached to said insert body for lifting said insert body from the manhole when said tether lock is unlocked and slidably displaced on said tether.

23. The manhole insert and tether apparatus of claim 22 comprising a gasket for engaging the manhole wall and said rim and sealing said insert body in the manhole and a padlock releasably engaging said tether lock for selectively locking said tether lock device on said tether and a keyhole clip mounted on said insert bottom and wherein said opposite end of said tether is connected to said keyhole clip.

24. The manhole insert and tether apparatus of claim 23 wherein said tether lock comprises an elongated, generally U-shaped lever bar receptacle including a first side having a first receptacle tether 1opening and a first receptacle lock opening spaced from said first receptacle tether opening; a second side continuous with said first side and having a second receptacle tether opening aligned with said first receptacle tether opening and a second receptacle lock opening aligned with said first receptacle lock opening; a generally rectangular lever bar extending from said lever bar receptacle and having a transversely-offset lever bar tether opening registering with said first receptacle tether opening and said second receptacle tether opening and a lever bar lock opening spaced from said lever bar tether opening, whereby said tether passes through said first receptacle tether opening, said lever bar tether opening and said second receptacle tether opening, respectively, and said lever bar is pivoted from a first position extending from said lever bar receptacle to a second position within said lever bar receptacle to crimp said tether responsive to manipulation of said lever bar inside said lever bar receptacle and wherein said padlock is extended through said first receptacle lock opening, said lever bar lock opening and said second receptacle lock opening, respectively, said padlock then locked to prevent said lever bar from pivoting from said lever bar receptacle and said tether from slipping through said tether opening.

25. A method of locking a manhole insert in a manhole beneath a manhole cover and preventing unauthorized entry into the manhole, comprising the steps of seating a manhole insert in the manhole; providing an opening in said manhole insert; securing a pair of tether mount loops in the manhole in spaced relationship with respect to each other; extending a flexible tether through said opening and said tether mount loops and securing one end of said flexible tether to said manhole insert; seating the manhole insert in the manhole; and sliding a tether lock on the opposite end of said flexible tether, whereby said manhole insert is secured in the manhole responsive to pulling said opposite end of said flexible tether through said opening to tighten said flexible tether between said manhole insert and said tether mount loops, sliding said tether lock on said opposite end of said flexible tether to said insert body and securing said tether lock on said flexible tether.

26. The method according to claim 25 comprising the step of attaching a lock to said tether lock for further securing said tether lock on said flexible tether.

27. The method according to claim 25 comprising the step of mounting a keyhole clip on said manhole insert in spaced relationship with respect to said opening and securing said one end of said flexible tether to said keyhole clip.

28. The method according to claim 25 comprising the steps of:

(a) attaching attaching a lock to said tether lock for further securing said tether lock on said flexible tether; and (b) mounting a keyhole clip on said manhole insert in spaced relationship with respect to said opening and securing said one end of said flexible tether to said keyhole clip.

* * * * *